US007398877B1

(12) United States Patent
Nelson et al.

(10) Patent No.: US 7,398,877 B1
(45) Date of Patent: Jul. 15, 2008

(54) CONTACT LENS CASE

(75) Inventors: Sterling H. Nelson, 145 River Point Ct., Alpharetta, GA (US) 30022; George W. Stough, Alpharetta, GA (US)

(73) Assignee: Sterling H. Nelson, Alpharetta, GA (US)

( * ) Notice: Subject to any disclaimer, the term of this patent is extended or adjusted under 35 U.S.C. 154(b) by 478 days.

(21) Appl. No.: 11/235,434

(22) Filed: Sep. 26, 2005

Related U.S. Application Data

(60) Provisional application No. 60/613,414, filed on Sep. 27, 2004.

(51) Int. Cl.
*A45C 11/02* (2006.01)

(52) U.S. Cl. ..... 206/5.1; 134/901; 206/5; 206/6

(58) Field of Classification Search ..... 206/5, 206/5.1, 6; 134/901; 294/1.2; D3/264
See application file for complete search history.

(56) References Cited

U.S. PATENT DOCUMENTS

| | | | | | |
|---|---|---|---|---|---|
| 3,977,517 | A | * | 8/1976 | Kadlecik et al. | 206/5.1 |
| 3,990,579 | A | * | 11/1976 | Manning | 206/5.1 |
| 4,392,569 | A | | 7/1983 | Shoup | |
| 4,942,959 | A | * | 7/1990 | Sauber et al. | 206/5.1 |
| 5,433,314 | A | * | 7/1995 | Lin | 206/5.1 |
| 5,474,169 | A | | 12/1995 | Bauman | |
| 5,573,108 | A | | 11/1996 | Hamilton et al. | |
| 6,086,823 | A | * | 7/2000 | Bourset | 422/28 |

* cited by examiner

*Primary Examiner*—Long Nguyen
*Assistant Examiner*—Jose S Stephens, III
(74) *Attorney, Agent, or Firm*—Kenneth S. Watkins, Jr.

(57) ABSTRACT

A contact lens case (101) comprises a base (103) having a left cavity (105A) and a right cavity (105B) for storing contact lenses (113A, 113B). An upward-facing base dome (109A, 109B) in each cavity supports the lenses with the rims of the lenses downward. A lid (106) comprises downward-facing lid domes (121A, 121B) to retain the lenses on the upward-facing domes of the base. The lid domes allow expelling of air during closing of the case to maintain good hydration of the lenses.

22 Claims, 11 Drawing Sheets

CONTACT LENS CASE

This application claims the benefits of U.S. Provisional Application No. 60/613,414 filed Sep. 27, 2004.

FIELD OF THE INVENTION

The present invention relates to contact lens cases, and in particular, lens cases having features to improve accessibility to the lens and to improve hydration qualities of the case.

BACKGROUND OF THE INVENTION

The popularity and use of contact lenses has grown with the introduction of designs such as soft contact lenses and disposable contact lenses. New materials, optical designs and fashion designs such as colored lenses have further popularized their use.

The new lens technologies have created new issues such as the need for better lens hydration and more stringent lens and case cleanliness requirements. Users also want the added convenience of accessories for lens care and use within easy reach. Case ergonomics and esthetic design have become more important to many users, especially women.

Earlier case designs have primarily focused on solving only one of the many issues facing contact lens users. There exists a need for a new case design that addresses many of the needs of modern contact lens users.

OBJECTS AND SUMMARY OF THE INVENTION

Therefore, an object of the present invention is to provide a contact lens case that provides full and constant hydration to the lens, especially the edges of soft contact lenses to improve comfort and wearability of the lens.

Another object of the present invention is to provide a contact lens case that can be opened quickly with the fingers of a hand holding the case.

Another object of the present invention is to provide a contact lens case that presents the lens in a position allowing transfer to or from the eye without reversing the lens in the hand.

Another object of the present invention is to provide a contact lens case that reduces possibilities of dropping, losing or reversing left and right lenses during use.

Yet another object of the present invention is to provide a case with a reduced number of manufactured parts.

Another object of the present invention is to provide a contact lens case that is simple and easy to maintain cleanliness.

Still another object of the present invention is to provide contact lens case having all the necessary accessories for lens insertion and removal and for lens care, and provides an attractive, esthetic design.

The contact lens case of the present invention comprises a dome in the base of the case having an upward facing convex surface for support of the lens in a position ready for insertion into the eye without reversing the lens. The lens is retained on the base dome by a downward-projecting retainer in the lid having a convex surface facing downward to prevent the lens from coming off the base dome when the lid is shut. In the preferred embodiments, the downward-projecting retainer is a downward facing lid dome having a close spacing with the base dome. A sufficient clearance is maintained between the base dome and the lid dome to allow the contact lens to be retained on the base dome convex surface but without contact from the lid dome in the normal position.

A fill level indicator in the base provides a desired level for an aqueous solution used for hydrating and/or providing antiseptic functions. In the preferred embodiments, the bottom portion of the lid dome contacts the aqueous solution surface before the lid is fully closed, expelling air during closing of the lid. The fill level indication and lid dome volume are chosen to expel substantially all of the air in the base chamber by the time the lid is fully shut. Elimination or substantial reduction of air by this process, together with support of the contact lens with the rim in a downward position, ensures that the lens, especially the rim portion remains fully hydrated. A rough lens rim, caused by poor rim hydration in many case designs can result in eye discomfort, pain and more serious complications. Full hydration of the lens improves eye comfort and wearability, especially for new users and for users utilizing contacts lenses positioned in the eye for considerably periods.

In the preferred embodiments of the invention, left and right contact lens case portions utilize a common base and lid. Two seal members, such as O-rings, seal the individual left and right chambers when the lid is closed. A catch, engagable and releasable by the fingers of a holding hand, allow opening and shutting the lid with one hand. In other embodiments, other closure means such as screw cap closures, tongue and groove closures, compression seals, or snap caps may be used.

In one embodiment of the invention, an eye care kit provides the left and right eye contact case in combination with an outer case. The base of the outer case contains the contact lens case and receptors for standard aqueous solution packages. The hinged lid contains a mirror such as a convex magnifying mirror to aid in the installation and removal of the contact lenses from the eye.

Other embodiment of the invention provide single contact lens cases, both reusable and disposable, utilizing the features of the invention.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

The following is a description of a case for a contact lens case having a double convex dome cavity for maintaining full hydration of a contact lens.

Figure 1:
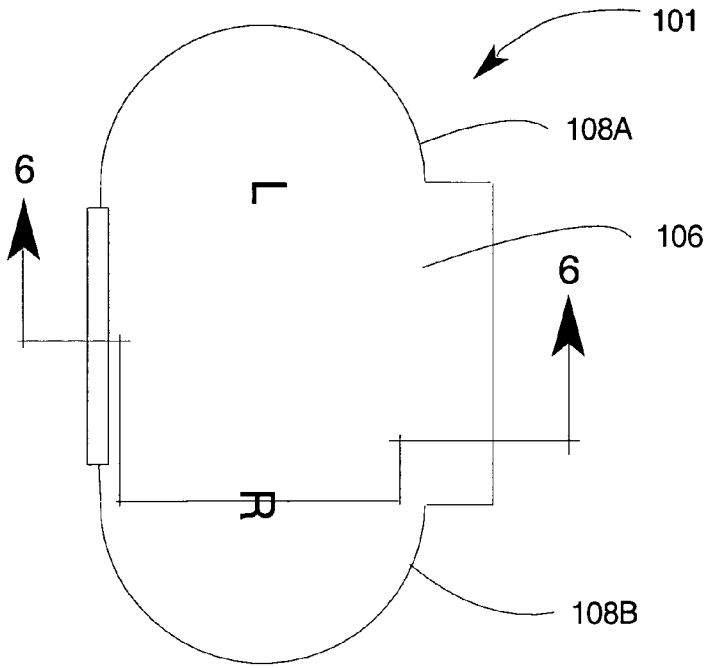
FIG. 1 is a top view of the contact case of the present invention with the lid closed.
Figure 2:
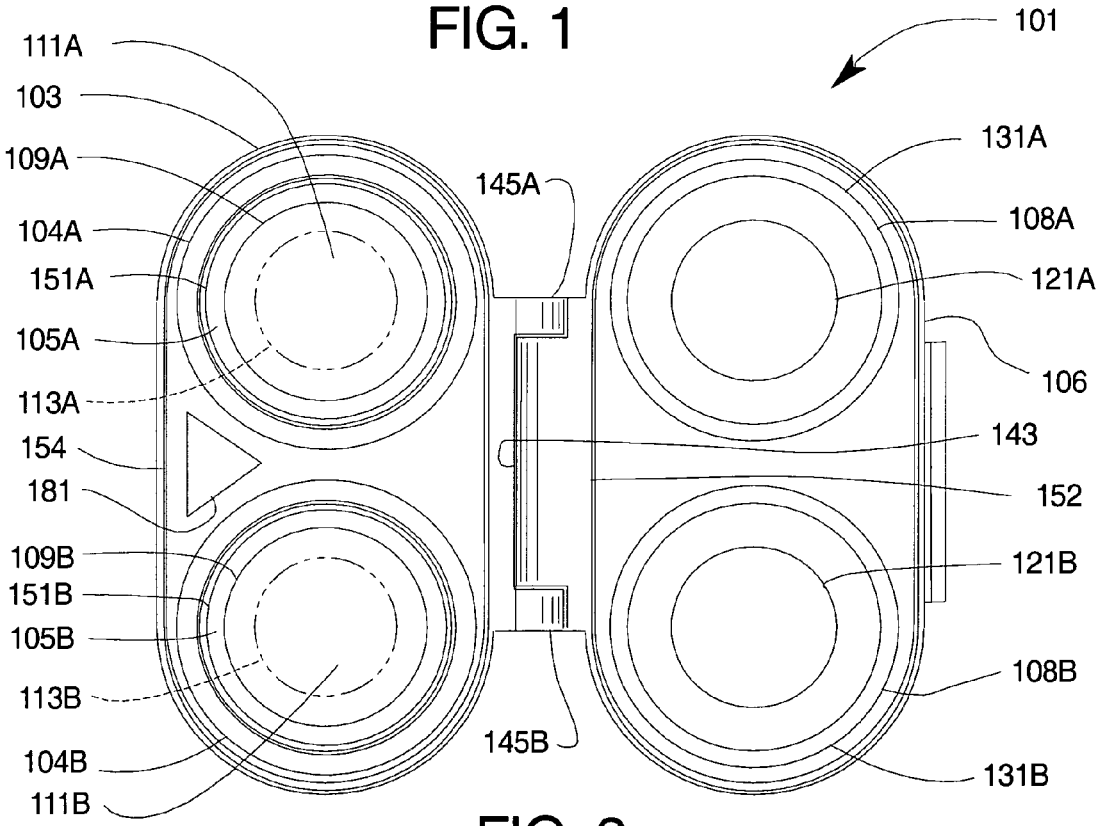
FIG. 2 is a top view of the contact lens case of FIG. 1 open, showing the left and right bottom portion and lid portions, orientation indicator, and left and right contact lenses shown in phantom lines.
Figure 3:
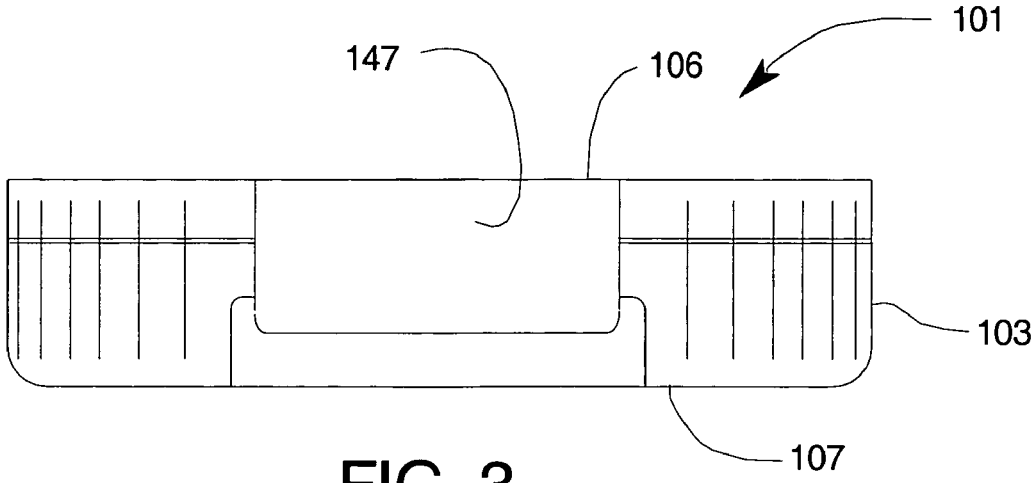
FIG. 3 is a front elevation drawing of the case of FIG. 1.
Figure 4:
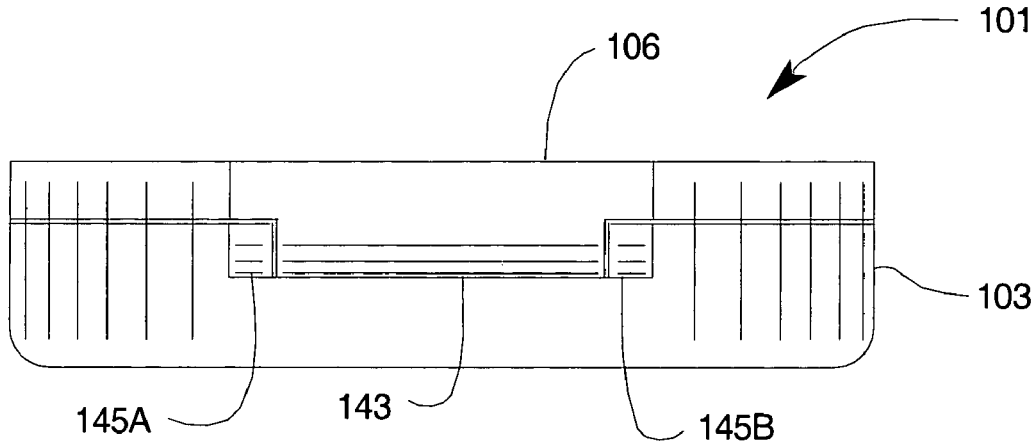
FIG. 4 is a back elevation drawing of the case of FIG. 1.
Figure 5:
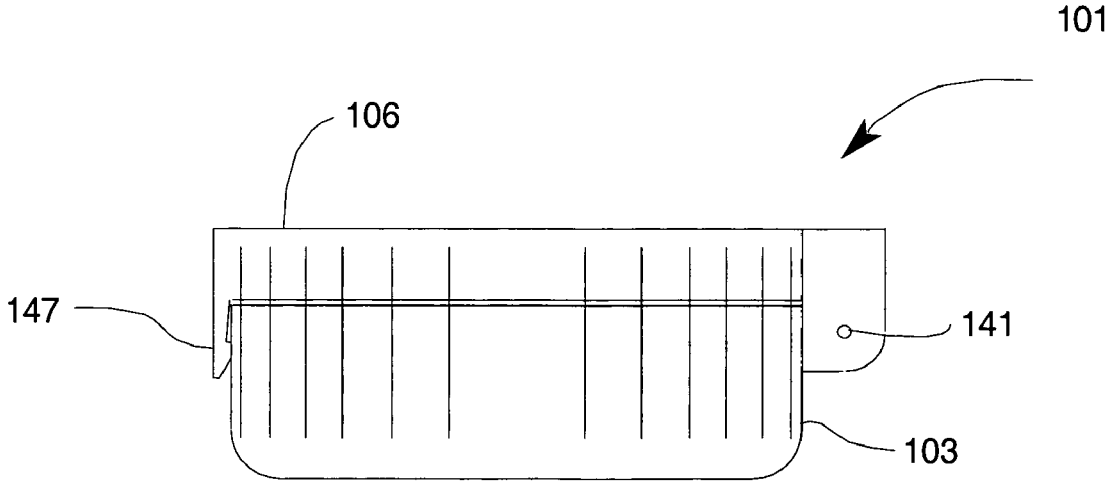
FIG. 5 is a right side elevation drawing of the case of FIG. 1, the right side being a mirror image.
Figure 6:
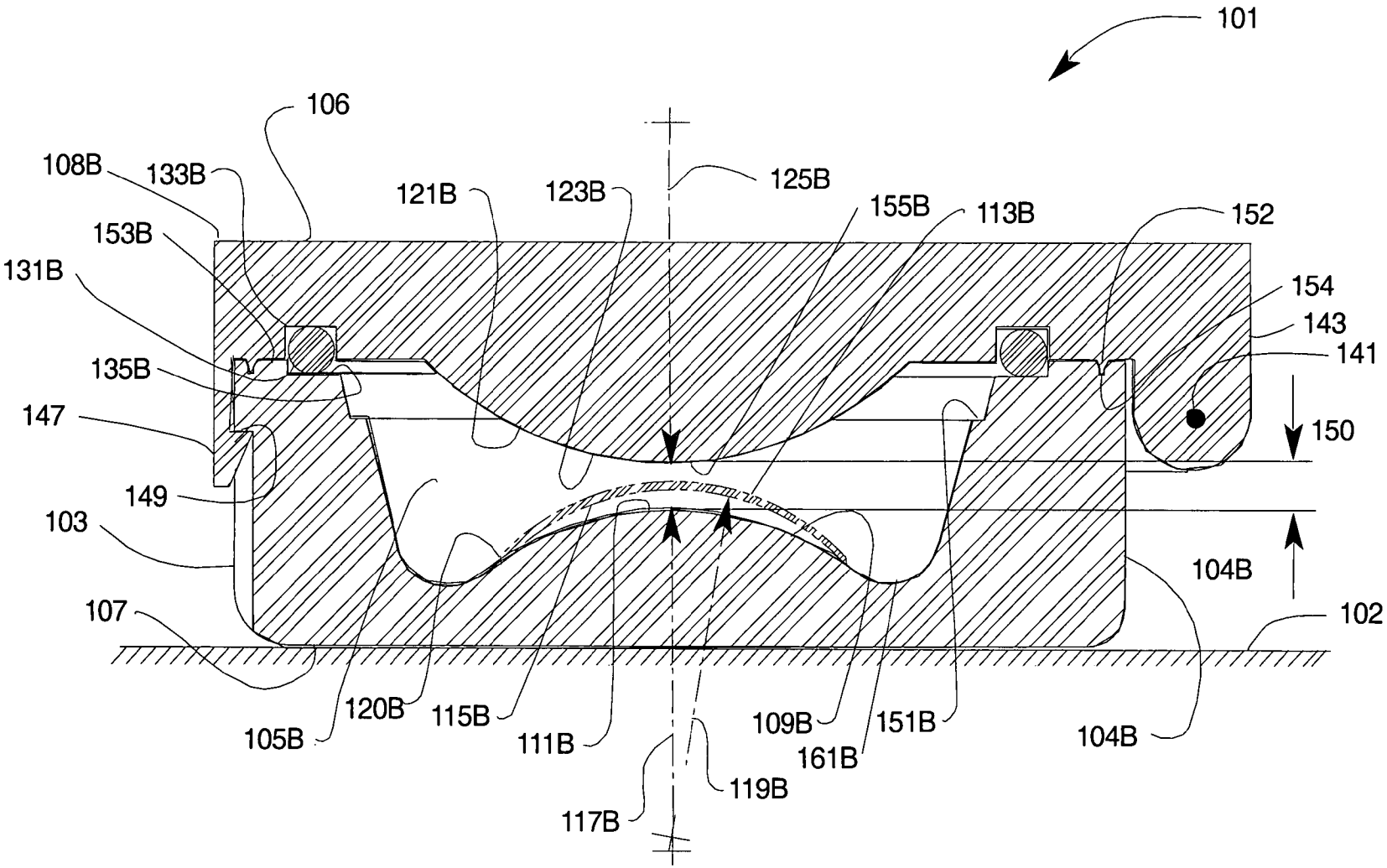
FIG. 6 is a cross section drawing of the case of FIG. 1 taken along lines 6-6 of FIG. 1.

FIGS. 1 and 2 are top views of contact lens case 101 in a closed and open position, respectively. FIGS. 3-5 are front, back and side view of the contact lens case in a closed position. FIG. 6 is a cross section drawing of lens case 101 taken along lines 6-6 of FIG. 1 and sitting on a horizontal support surface 102. Although FIG. 6 shows the right side case components, the left side components are similar.

Contact lens case 101 consists of a base 103 having left and right base portions 104A, 104B and a lid 106 having left and right lid portions 108A, 108B. Base support surface 107 supports base 103 in the position shown in FIG. 6.

Each base portion 104A, 104B of case 101 comprises a base cavity 105A, 105B for storing a contact lens 113A, 113B shown in phantom lines. Each cavity 105A, 105B has an upward-facing base dome 109A, 109B having a convex surface portion 111A, 111B facing upward when base support surface 107 of base 103 is supported from horizontal support surface 102 as best seen in the cross section of FIG. 6.

Convex surfaces 111A, 111B form a supporting surface for contact lenses 113A, 113B. Contact lenses 113 A, 113B are supported from convex surfaces 111A, 111B with the concave side, 115B of FIG. 6, facing toward the convex surface 111B of base dome 109B. In the preferred embodiments, the radius of curvature 117B of convex surface 111B is slightly greater than the radius of curvature of the convex surface 115B of contact lens 113B so that the lens is supported from lens rim 120B and minimizes the concave surface area of lens 113B in contact with convex surface 111B. In other embodiments, the radius of curvature 117B of convex surface 111B is substantially the same, or smaller than, the radius of curvature 119B of lens 113.

Each lid portion 108A, 108B comprises a downward-facing lid dome 121A, 121B. Each dome 121A, 121B comprises a convex surface portion 123A, 123B facing downward when lid 106 is in the closed position and base support surface 107 is supported from a horizontal support surface 102 as shown in FIG. 6. Left side components are similar.

In the preferred embodiments case 101 comprises a seal, such as O-ring seals 131A, 131B to seal respective base portions 104A, 104B and lid portions 108A, 108B. As best seen in FIG. 6, O-ring 131B, retained in groove 133B of lid portion 108B seals against seal rim 135B of base portion 104B when lid 106 is in the closed position. Left side seal components are similar.

In the preferred embodiments, lid 106 is a hinged lid. Hinge pin 141 forms a pivot between lid hinge portion 143 and base hinge portions 145A, 145B. A closure clasp such as resilient clasp 147 of lid 106 engages clasp-retaining ledge 149 of base 103 to retain lid 106 securely to base 103. "Nose" indicator 181 provides an orientation indicator for use of the case, i.e. so that nose indicator 181 faces the user and the left base portion 104A and right base portion 104B are in the proper orientation during use.

In the preferred embodiments base and lid dome shapes and cavity 105A, 105B depths are selected so that the dome spacing 150 between base domes 109A, 109B and respective lid domes 121A, 121B is slightly greater than the thickness of a typical contact lens. The spacing ensures adequate securing of contact lenses 113A, 113B on the respective base domes during severe mechanical disturbance, while preventing compression between the base and lid domes when the lid is closed. In the preferred embodiments, this spacing is typically less than 0.5 cm, more preferably less than 0.25 cm, and in the most preferred embodiments, less than 0.15 cm. A fill level indicator such as ledge 151B, located below top rim 153B and, preferably, seal rim 135B of FIG. 6 provides an initial solution fill indicator as explained in the following sections. The lowest point or tip 155B of lid dome 121B extends below fill level indicator 151B.

In the preferred embodiments, a second seal such as a tongue and groove seal is used to prevent any overflow from bottom 104A, 104B or top 108A, 109B portions from external spillage. Tongue portion 152 of the seal on lid 106 mates with groove portion 154 of base 103 to seal both left and right portions of the case from external leakage.

Figure 7A:
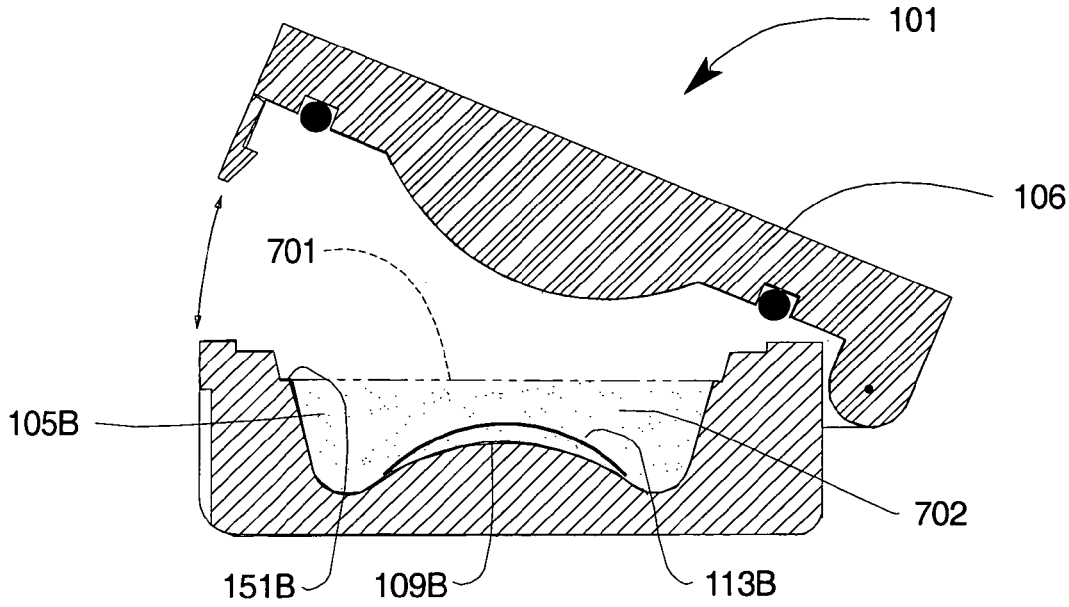
FIG. 7A is a cross section drawing of the case of FIG. 1 showing the initial level of an aqueous solution added to the fill level indicator of the base of the case and the lid in an open position.
Figure 7B:
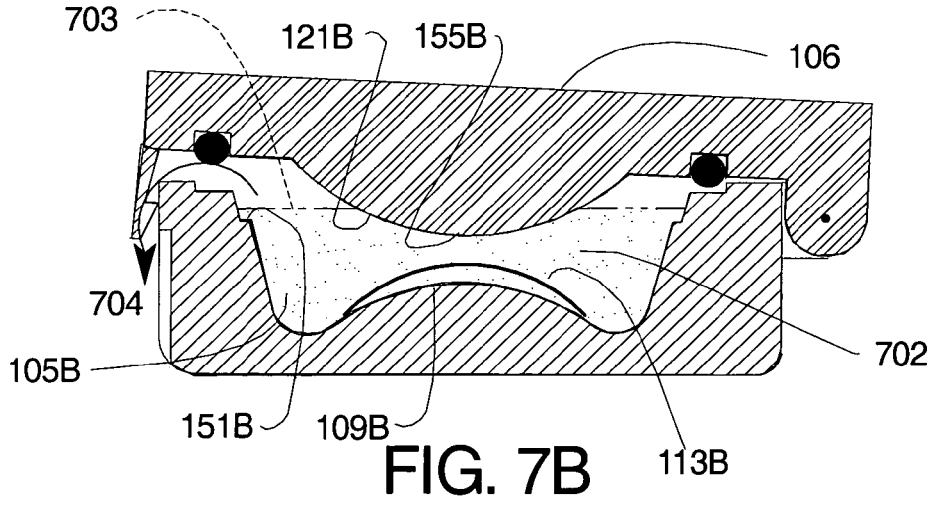
FIG. 7B is a cross section drawing of the case of FIG. 1 showing the lid being lowered towards a closed position with the tip of the lid dome submerged below the aqueous solution level and the initial fill level indicator and air being expelled from the cavity of the case.
Figure 7C:
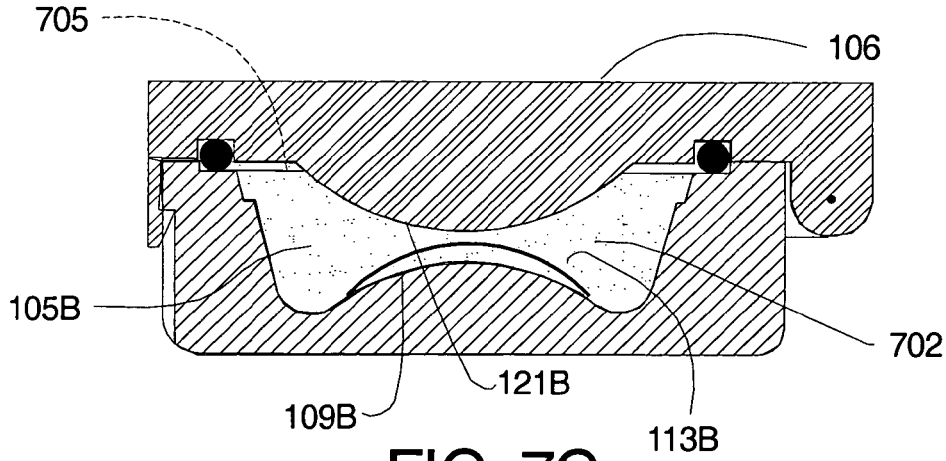
FIG. 7C is a cross section drawing of the case of FIG. 1 showing the lid in a fully shut position with substantially all of the air being expelled from the cavity of the case.

FIGS. 7A, 7B and 7C are cross section drawings of contact lens case 101 showing the encapsulation and hydration features of the case during use. The tongue 152B and groove 154B seal portions and background features are not shown for clarity. FIG. 7A shows lid 106 of case 101 in an open position with contact lens 113B inserted on base dome 109B and the initial liquid level 701 of aqueous solution 702 at the fill level indicator 151B. FIG. 7B shows lid 106 of case 101 in a partially closed position where the tip 155B of lid dome 121B is inserted below the fill level indicator 151B. In this position, the volume displacement of lid dome 121B has raised the level of aqueous solution 702 to the level shown by level 703 and displacing air as shown by arrow 704. FIG. 7C shows lid 106 in a fully closed and latched condition. In this position, the volume displacement of lid dome 121B has raised the level of aqueous solution 702 to the level shown by level 705. In the preferred embodiments, level 705 is approximately at the level of seal rim 135B and displaces most or substantially all of the air in cavity 105B.

Elimination of air in cavity 105B ensures good hydration of contact lens 113B, even if the case is turned or inverted. Well portion 161B of cavity 105B, extending below lens rim portion 120B permits accumulation of any tiny bubbles of air remaining in cavity 105B upon inversion of case 101.

Figure 8A:
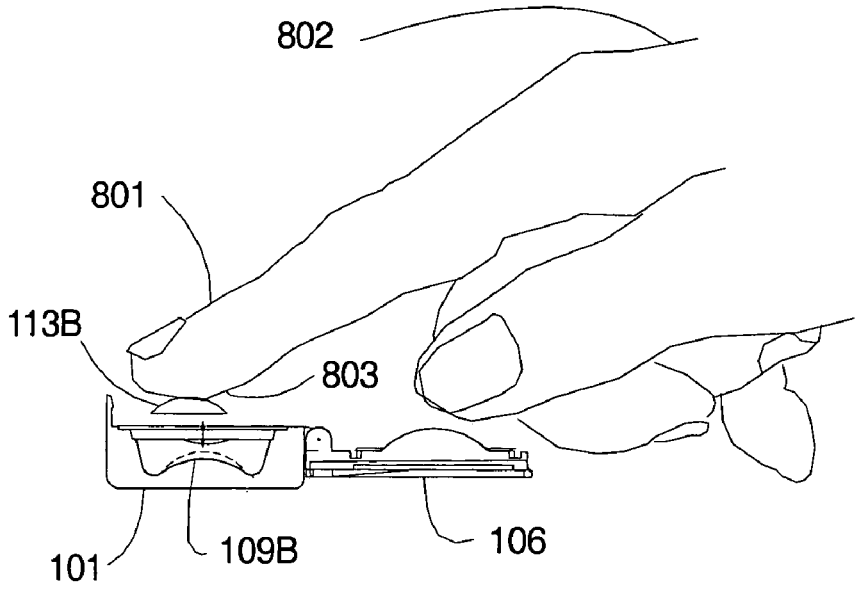
FIG. 8A is a perspective drawing of a finger of a hand retrieving a contact lens from, or inserting a contact lens on, the base dome of the contact lens case of FIG. 1 and utilizing the capillary attraction of the lens and the skin of the finger.
Figure 8B:
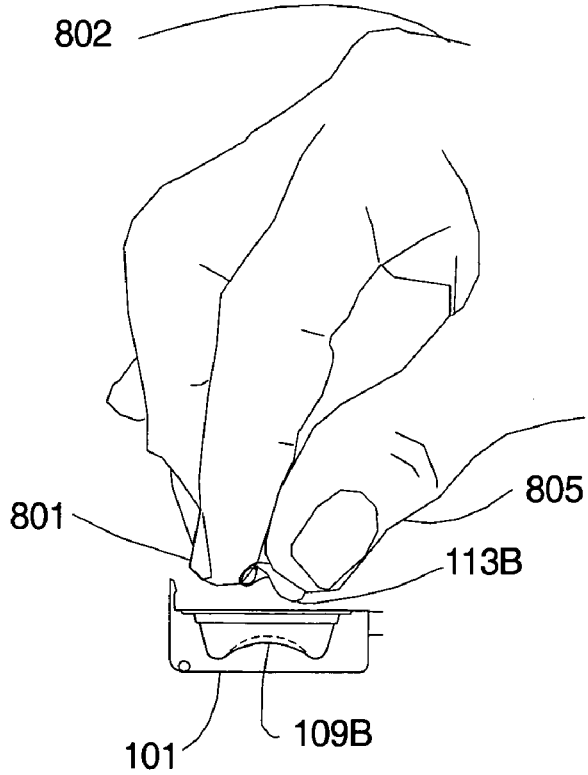
FIG. 8B is a perspective drawing of a finger and thumb of a hand retrieving a contact lens from, or inserting a contact lens on, the base dome of the contact lens case of FIG. 1 by grasping the lens with the thumb and finger, no inversion or reversing of the lens required for removal from, or insertion into, the eye.

FIG. 8A shows a method of removing or inserting contact lens 113B in case 101 with lid 106 open. Touch contact of a finger 801 of hand 802 with lens 113B allows transfer to or from base dome 109B of case 101 by capillary attraction between contact lens 113B and bottom portion 803 of finger 801. FIG. 8B shows another means of installing or removing lens 113B from bottom dome 109B. Pinching lens 113 by the finger 801 and thumb 805 of hand 802 allows placement of lens 113B on dome 109B as shown in the figure. The upwards-facing dome 109B in the base of case 101 allows the removal or insertion of lens 113B into or out of an eye and transfer to or from case 101 without inversion of the lens.

Figure 9A:
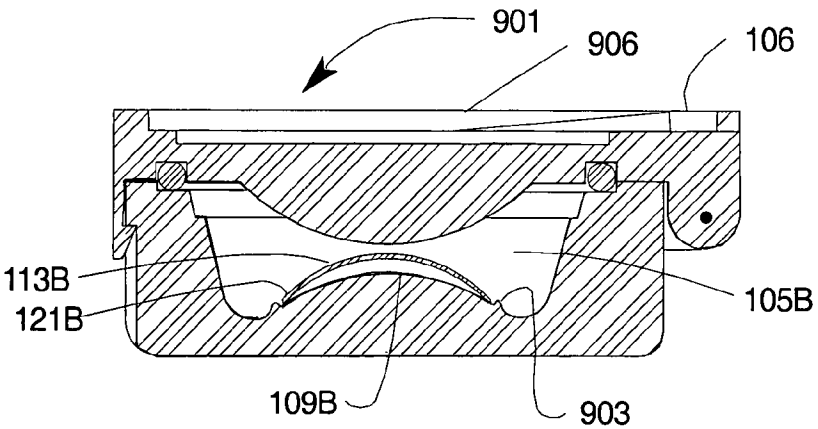
FIG. 9A is a cross section drawing of an alternative embodiment of the base of the case of FIG. 1 utilizing a raised ridge to aid in retaining a contact lens on the convex surface of the base dome of the case.
Figure 9B:
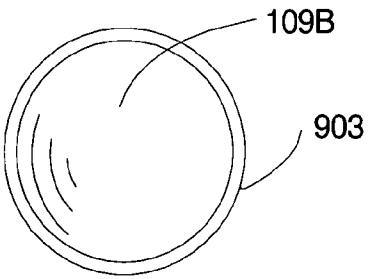
FIG. 9B is a detail plan view of the base dome of FIG. 9A with the contact lens removed.
Figure 12A:
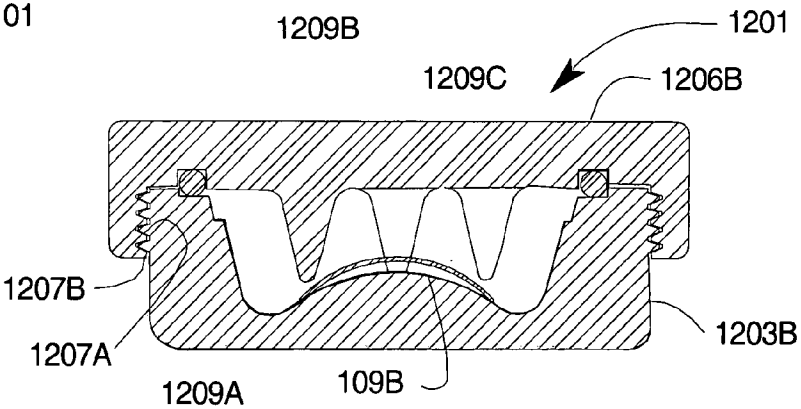
FIG. 12A is a cross section drawing of an alternative embodiment of the lid of the case of FIG. 1 utilizing a screw cap and a plurality of downward-projecting elements to retain the lens on the base dome.
Figure 12B:
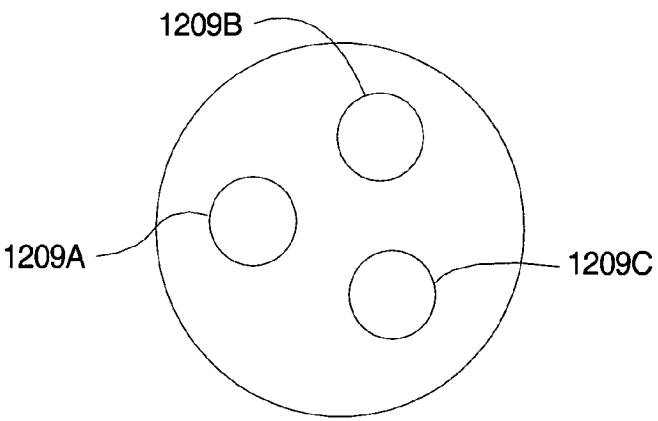
FIG. 12B is detail bottom view of the case lid showing the elongated downward-projecting elements of FIG. 12A.

FIG. 9A is a cross section drawing of an alternative embodiment case 901 utilizing a raised circumferential ridge 903 on base dome 109B. Ridge 903 engages the rim 120B of contact lens 113B to retain the lens centered on base dome 109B. FIG. 9B is a detail plan view of the dome portion of cavity 105B with lens 113B removed for clarity. FIG. 9A also shows a recessed lid portion 906 of lid 106.

Figure 10A:
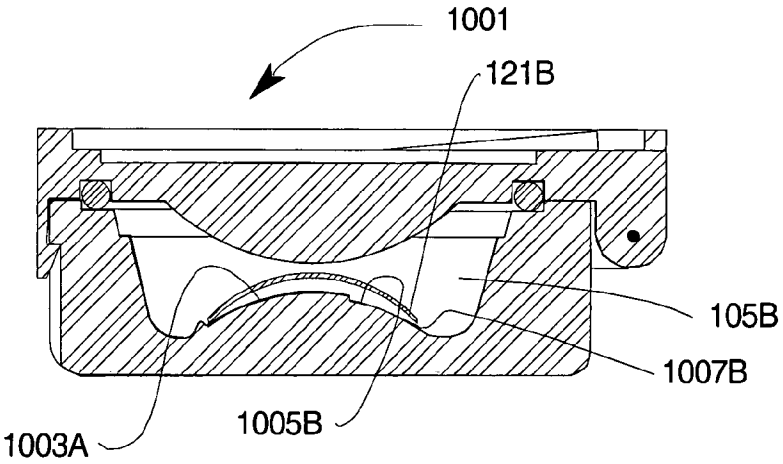
FIG. 10A is a cross section drawing of an alternative embodiment of the base of the case of FIG. 1 utilizing recessed portions on the base dome to provide gaps between the rim of the contact lens and the base dome.
Figure 10B:
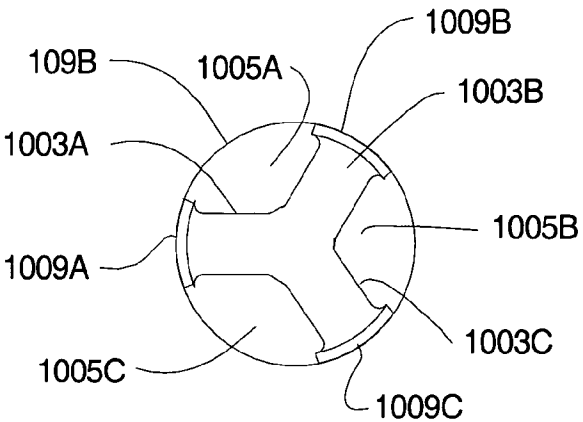
FIG. 10B is a detail plan view of the base dome of FIG. 10A with the contact lens removed.

FIG. 10A is a cross section drawing of an alternative embodiment case 1001 having raised ribs 1003A, 1003B, 1003C forming base dome 109B. Raised ribs 1003A, 1003B, 1003C provide cavity portions 1005A, 1005B, 1005C between the raised rib portions allowing gaps such as gap 1007B between contact lens rim 120B and cavity portion 1005B, 1005C to allow exchange of an aqueous fluid in base cavity 105B. Ridge portions 1009A, 1009B, 1009C provide support for lens 113B. FIG. 10B is a plan view of dome 109B with lens 113B removed for clarity.

Figure 11A:
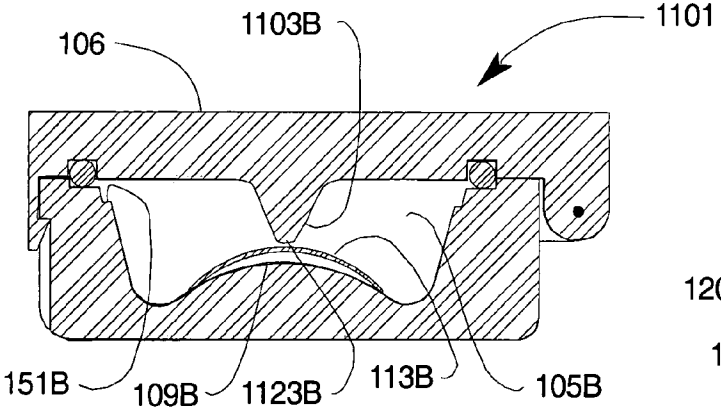
FIG. 11A is a cross section drawing of an alternative embodiment of the lid of the case of FIG. 1 utilizing an elongated downward-projecting element from the lid to retain the contact lens on the base dome.
Figure 11B:
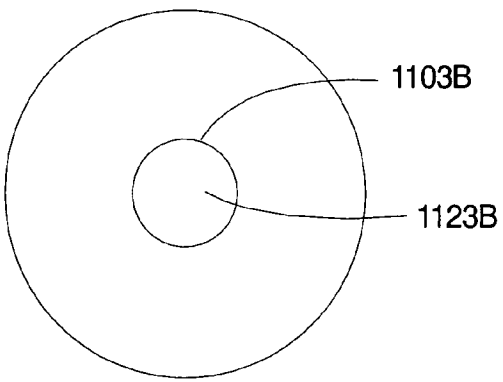
FIG. 11B is detail bottom view of the case lid showing the elongated downward-projecting element of FIG. 11A.

FIG. 11A is a cross section drawing of case embodiment 1101 having a lid projection 1103B with downward-facing convex surface 1123B for retaining lens 113B on base dome 109B. Lid projection 1103B also performs the volume displacing function of lid dome 121B of FIGS. 7A, 7B, 7C. The volume of lid projection 1103B and height of fill indicator 151B is adjusted to provide substantial elimination of air in cavity 105B when lid 106 is in the closed position shown. FIG. 11B is a partial view of the inside of lid 106 looking from the bottom of cavity 105B.

FIG. 12 A is a cross section drawing of case embodiment 1201 having a screw-type cap 1206B engaged to base 1203B by cap threads 1207B and complementary base threads 1207A. Lid 1206B utilizes a plurality of lid projections 1209A, 1209B, 1209C to retain lens 113B on dome 109B. Projections 1209A-1209C also perform the volume displacement function of lid dome 121B of FIGS. 7A-7C. Base dome 109B may utilize raised ridge such as ridge 903 of FIG. 9A, or it may utilize raised ribs and cavity portions as shown in FIGS. 10A, 10B. Case embodiment 1201 may be the right base and lid portions of case 101 of FIGS. 1-6, or it may be an individual lens container used for a single contact lens.

FIG. 12 C is a cross section drawing of case embodiment 1221 having a screw-type cap 1226B engaged to base 1203 by screw threads 1207B, 1207A. Convex retaining elements 1223B attached to projection 1225B of lid 1226B project downward as described in previous embodiments and prevent lens 113B from being dislodged from base dome 109B. Convex retaining elements 1223B and projection 1225B perform the volume displacement functions of lid dome 121B of embodiment 101. FIG. 12D is a detail bottom view of lid 1226B showing three retaining elements. In other embodiments, different number or shapes of retaining elements may be used.

Figure 12E:
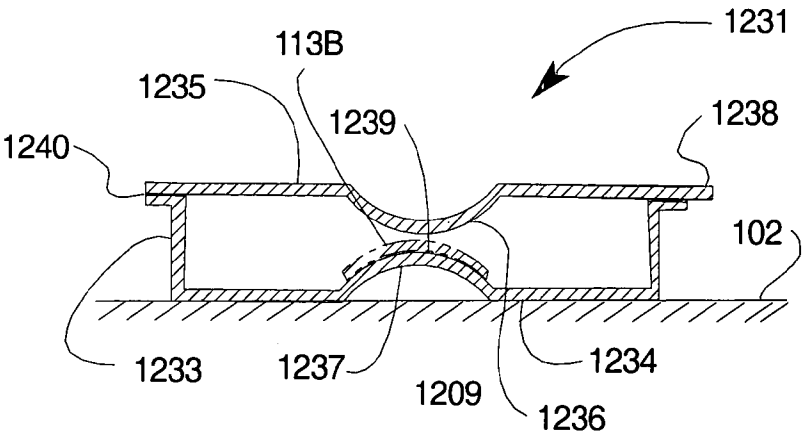
FIG. 12E is a cross section drawing of an alternative embodiment of the invention showing a disposable base having an upward-facing dome in the base and a downward-facing dome on the lid.
Figure 12C:
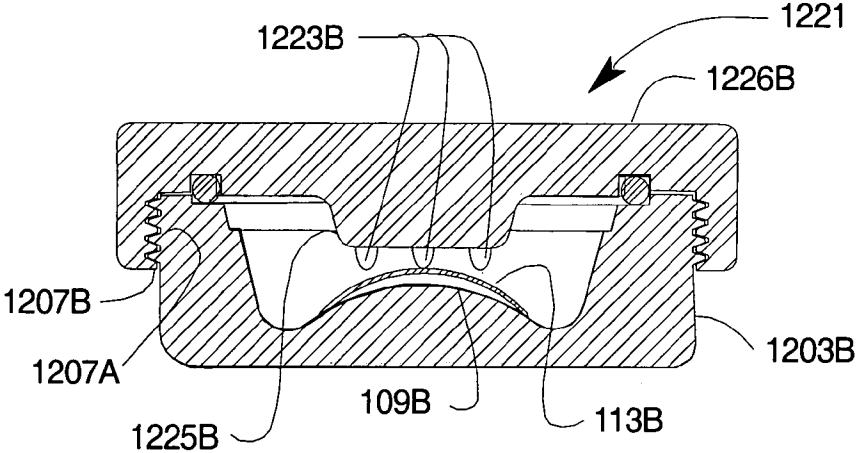
FIG. 12C is a cross section drawing of an alternative embodiment of the lid of the case of FIG. 1 utilizing a screw cap and a plurality of dome elements to retain the lens on the base dome.
Figure 12D:
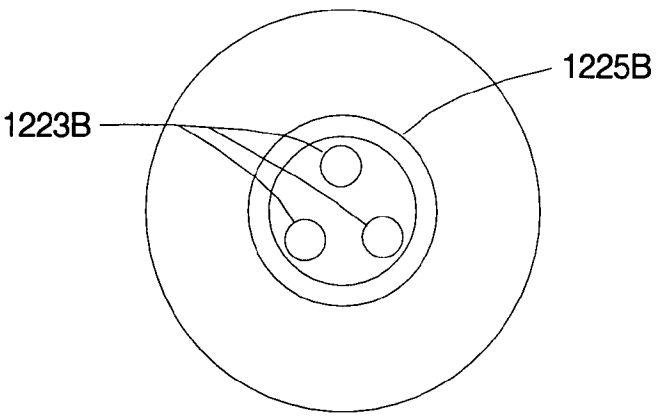
FIG. 12D is detail bottom view of the case lid showing the dome elements of FIG. 12C.
Figure 13:
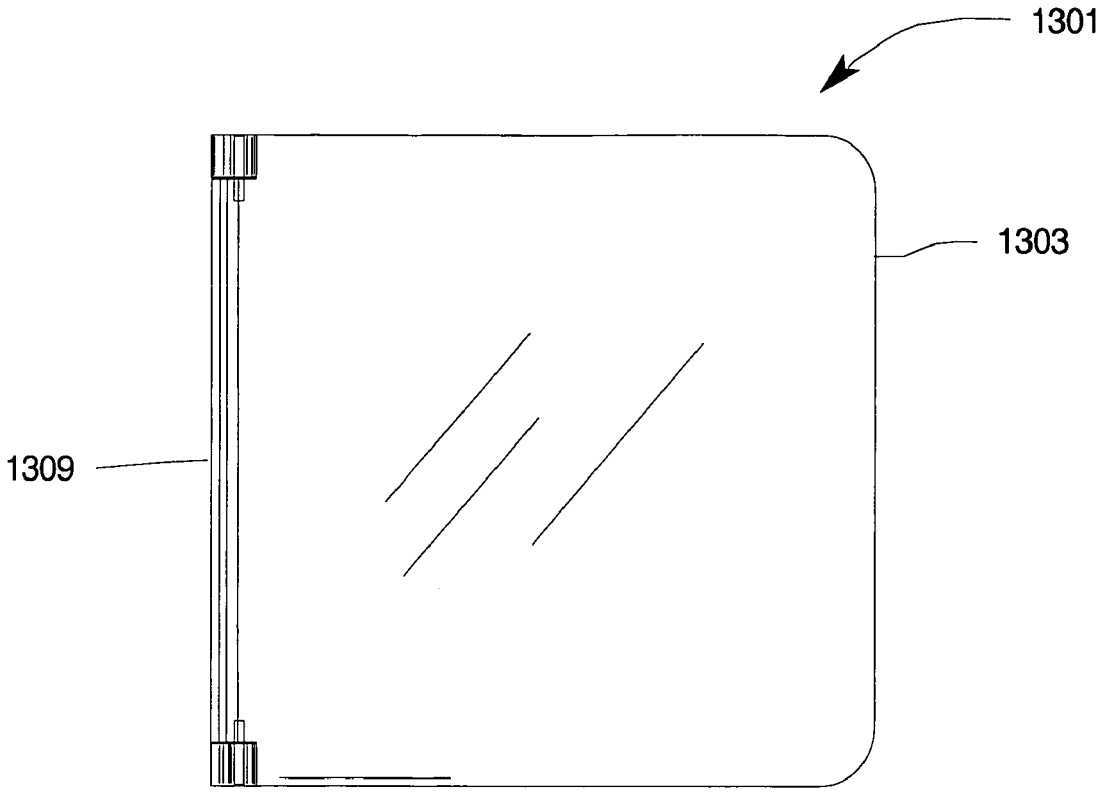
FIG. 13 is a top view of an eye care kit utilizing the contact lens case of FIG. 1.
Figure 14:
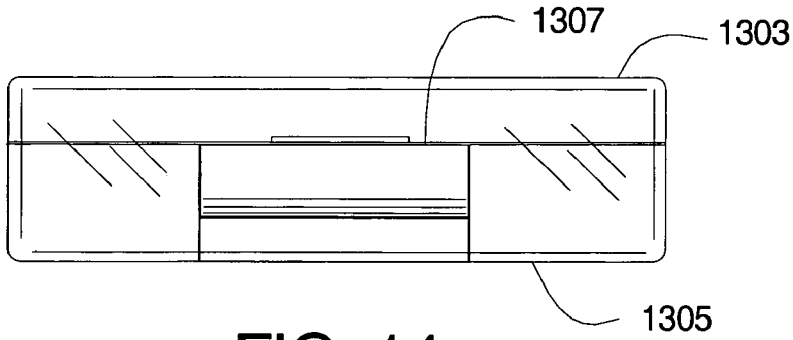
FIG. 14 is a front elevation drawing of the eye care kit of FIG. 13.
Figure 15:
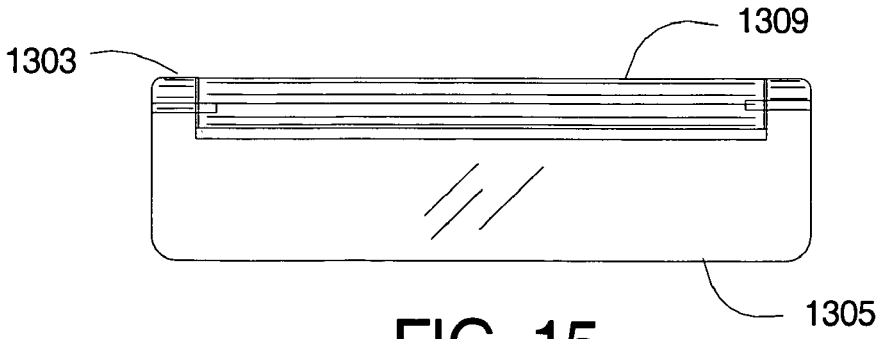
FIG. 15 is a back elevation drawing of the eye care kit of FIG. 13.

FIG. 12E is a cross section drawing of embodiment 1231 of the contact lens case having a disposable base 1233 and a disposable lid 1235. Base 1233 comprises a dome 1237 having a convex lens retaining portion 1239 facing upward when base support surface 1234 is supported from a horizontal support surface 102. Lens retaining portion 1239 supports contact lens 113B in the position shown. In this embodiment, the radius of curvature of base dome 1237 is selected to be approximately the same radius of curvature of the concave surface of lens 113B to provide good capillary attraction between lens 113B and dome 1237. Lid 1235 comprises a downward facing dome 1236 for retaining lens 113B on base dome 1237. In other embodiments, other downward projecting elements and/or base dome retaining ridges are utilized. In the preferred embodiments, lid 1235 is attached to base 1233 by adhesive 1240. In other embodiments, heat seals, or other seal means known in the art are used to attach lid 1235 to base 1234. A peel strip 1238 provides a convenient means to remove peel disposable lid 1235.

Figure 17:
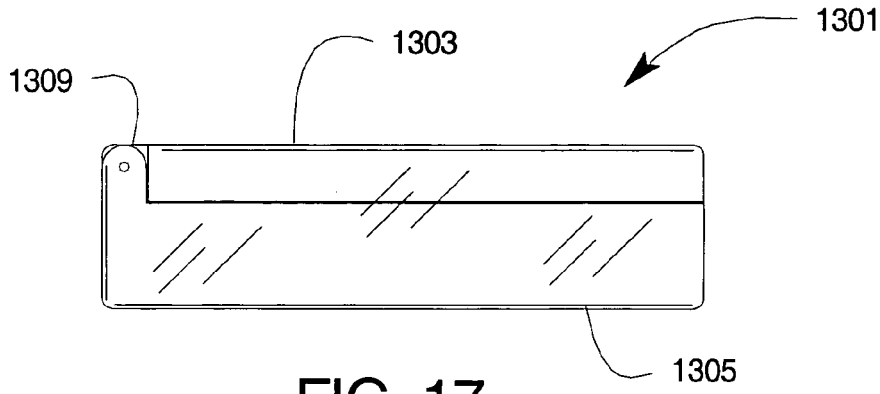
FIG. 17 is a left side elevation drawing of the eye care kit of FIG. 13, the right side being a mirror image.
Figure 17A:
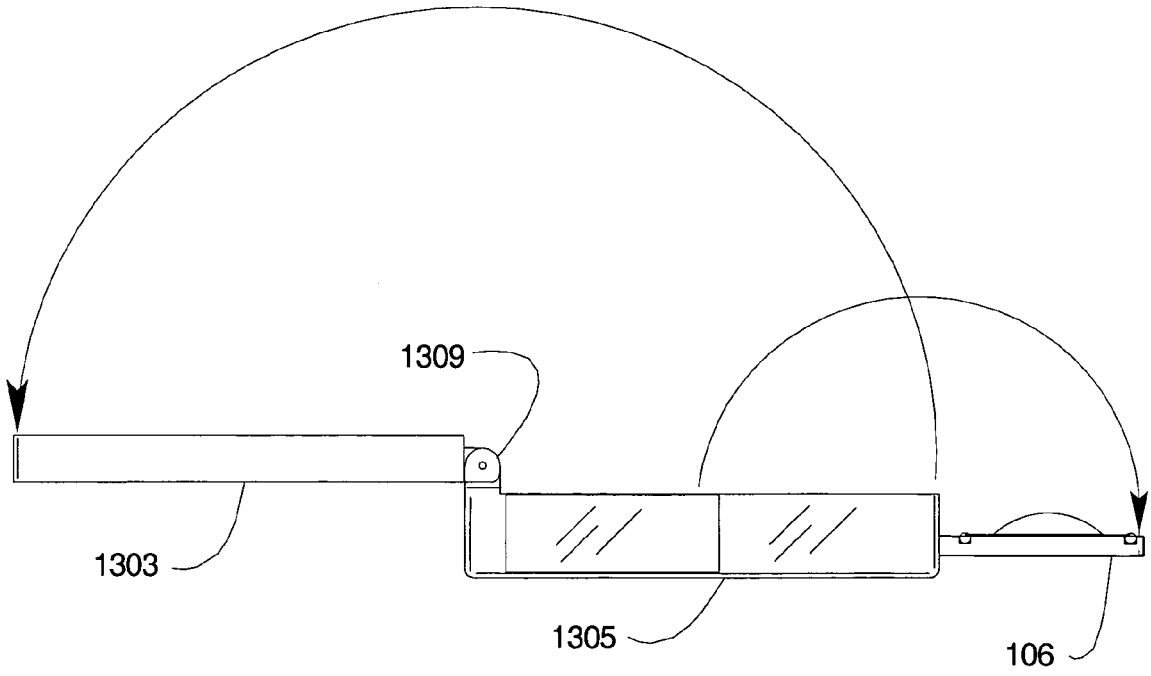
FIG. 17A is a left side elevation drawing of the eye care case of FIG. 13 showing the outer case lid and contact lens case lids in an open position.

FIGS. 13, 14, 15, and 17 are top, front, back and left side views an eye care kit 1301 having a case lid 1303, case bottom 1305, case lid latch 1307 and case lid hinge 1309. FIG. 17A is a left side elevation drawing of kit 1301 with case lid 1303 pivoted about hinge 1309 to an open position and contact lens cover 106 pivoted about hinge 143 to an open position.

Figure 16:
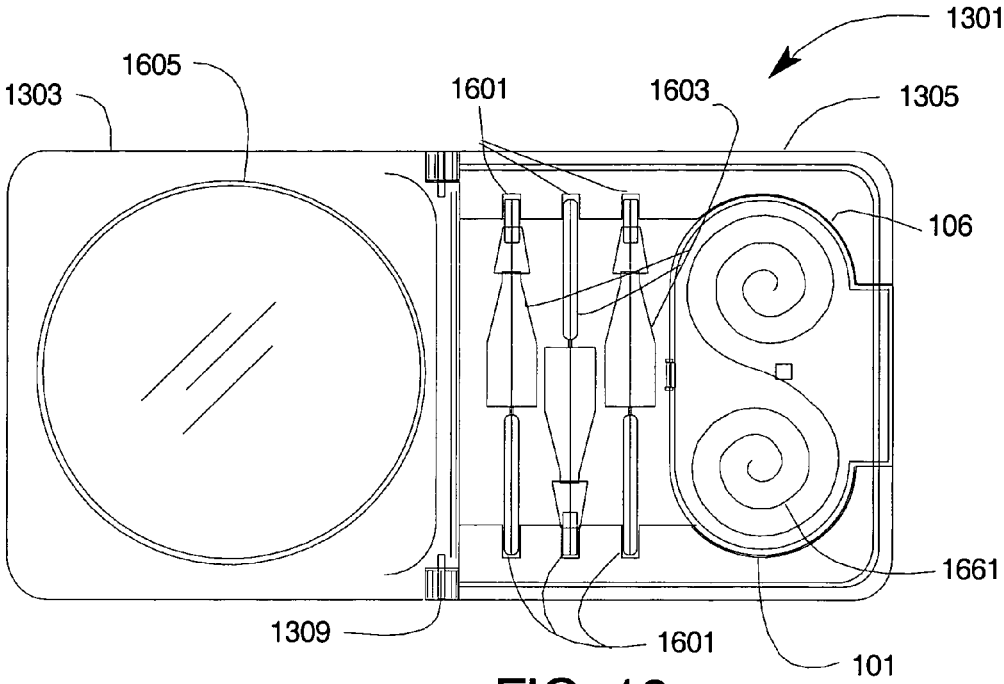
FIG. 16 is a top view of the eye care kit of FIG. 13 showing the outer lid in an open position.
Figure 16A:
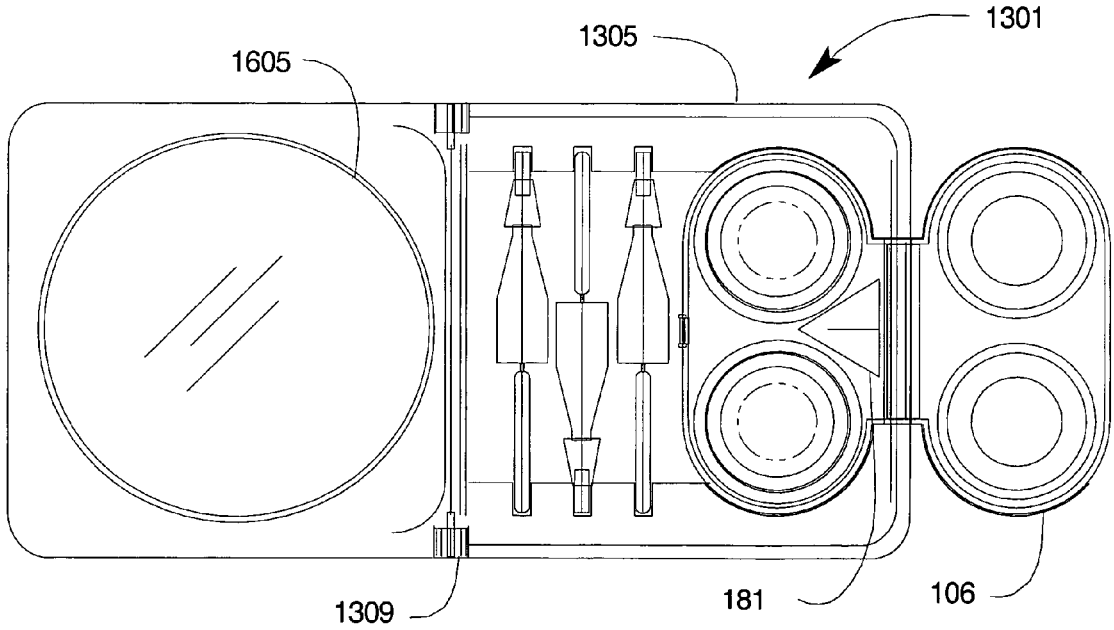
FIG. 16A is a top view of the eye care kit of FIG. 13 showing the outer lid and contact lens case lid in an open position.

FIG. 16 is a top view of eye care kit 1301 with case lid 1303 open showing engagement slots 1601 for securing eye care solution containers 1603. Engagement slots 1601 form an interference fit with solution containers 1603. A mirror, such as convex mirror 1605 provides a magnified image for insertion and removal of contact lenses secured in contact lens case 101 similar to FIGS. 1-6. A decorative design 1661 is shown on lid 106. FIG. 16A is a top view of eye care kit 1301 with contact lens case lid 106 opened. "Nose" indicator 181 provides proper orientation to the user, i.e. facing mirror 1605 and reduces likelihood of lens reversal by a user. The construction and operation of contact lens case 101 is described previously.

In the preferred embodiments, the contact lens case is made of plastic materials, such as thermoplastics or thermosets known in the art. In the preferred embodiments, the case lid and base are injection molded. In other embodiments, the case lid and base are vacuum formed, rotationally molded, or cast or machined from stock material.

Although the description above contains many specifications, these should not be construed as limiting the scope of the invention but merely providing illustrations of some of the presently preferred embodiments of this invention. For example, the base dome or top dome may be formed by ribs such as a crossed rib pattern instead of a smooth dome. Or other seal method such as compression seal caps may be used. In other embodiments, engagement slots 1601 may be used for spare contact storage. Thus the scope of the invention should be determined by the appended claims and their legal equivalents, rather than by the examples given.

We claim:

1. A case for contact lenses comprising;

a base comprising a base support surface, a first base cavity and a first base support dome comprising a first base convex surface and disposed in said first cavity with said first convex surface facing upward when said base support surface is supported by a horizontal support surface;

a lid comprising a first lid support dome comprising a first lid convex surface facing downward when said lid is in a closed position and said base support surface is supported by said horizontal support surface.

2. The case of claim 1 wherein said base comprises a liquid level indicator below a top rim of said first cavity and said first lid convex surface is disposed below said liquid level indicator when said lid is in said closed position.

3. The case of claim 2 wherein said first lid support dome comprises a predetermined volume wherein substantially all of an air volume is displaced from said first cavity when an aqueous solution is initially added to said liquid level indicator and said lid is in said closed position.

4. The case of claim 1 wherein said first base convex surface comprises a radius of curvature greater than an average radius of curvature of a human eye.

5. The case of claim 1 wherein said first base convex surface comprises a radius of curvature substantially equal to an average radius of curvature of a human eye.

6. The case of claim 1 wherein said first base support dome comprises a first support rim engageable with an outside rim of a contact lens.

7. The case of claim 1 wherein a first clearance between said first base convex surface and said first lid convex surface when said lid is in a closed position is less than 0.25 cm.

8. The case of claim 1 comprising a seal element between said base and said lid when said lid is in a closed position.

9. The case of claim 8 wherein said seal element is an O-ring disposed in a seal groove disposed in said lid.

10. The case of claim 1 wherein said lid is operatively connected to said base by a hinge.

11. The case of claim 10 wherein said lid comprises a latch element and said base comprises a complementary latch element disposed opposite said hinge.

12. The case of claim 1 wherein said base comprises a second cavity comprising a second base support dome.

13. The case of claim 12 wherein said second base support dome comprises a second base convex surface facing upward when said base support surface is supported by a horizontal support surface.

14. The case of claim 13 wherein said lid comprises a second lid support dome comprising a second lid convex surface facing downward when said lid is in a closed position and said base support surface is supported by said horizontal support surface.

15. A case for contact lenses comprising;

a base comprising a base support surface, a first base cavity and a first base convex surface disposed in said first cavity, said first base convex surface facing upward when said base support surface is supported by a horizontal support surface whereby a contact lens is supported from said first base convex surface with a lens concave surface of said contact lens facing said first base convex surface;

a lid comprising a first lid retaining element projecting downward and comprising a first lid convex surface facing downward when said lid is in a closed position and said base support surface is supported by said horizontal support surface whereby said first lid convex surface retains said contact lens on said first base convex surface.

16. The case of claim 15 wherein a spacing between said first base convex surface and said first lid convex surface is less than 0.25 centimeters when said lid is in said closed position.

17. The case of claim 15 wherein a spacing between said first base convex surface and said first lid convex surface is less than 0.15 centimeters when said lid is in said closed position.

18. The case of claim 15 wherein said first base convex surface comprises a ridge for retaining a rim of said contact lens.

19. The case of claim 15 wherein said first base convex surface comprises an upward facing dome.

20. The case of claim 15 wherein said first lid convex surface comprises a downward facing dome.

21. The case of claim 15 comprising a plurality of lid retaining elements, each of said plurality of lid retaining elements comprising a downward facing convex surface.

22. The case of claim 15 wherein said first base cavity comprises a fill level indicator whereby said first lid retaining element extends below said fill level indicator when said lid is in a closed position to expel air from said base cavity when closing said lid.

* * * * *